US005214900A

United States Patent [19]

Folkerts

[11] Patent Number: 5,214,900

[45] Date of Patent: Jun. 1, 1993

[54] METHOD AND MEANS FOR SUPPORTING OVERHEAD JOISTS TO CREATE GREATER HEADROOM

[76] Inventor: Cornelius Folkerts, R.R. #1, Box 184, Inwood, Iowa 51240

[21] Appl. No.: 706,020

[22] Filed: May 28, 1991

[51] Int. Cl.[5] ..... E04B 1/00; E04C 3/292

[52] U.S. Cl. ..... 52/696; 248/57; 52/643; 52/693; 52/692; 52/317; 52/264

[58] Field of Search ..... 52/264, 265, 643, 693, 52/692, 690, 317, 696, 712, 702, 92; 248/200.1, 57

[56] References Cited

U.S. PATENT DOCUMENTS 4,027,439 6/1977 Willard ..... 52/696
4,463,923 8/1984 Reiker ..... 248/57

FOREIGN PATENT DOCUMENTS 525784 12/1976 U.S.S.R. ..... 248/317

*Primary Examiner*—Carl D. Friedman
*Assistant Examiner*—Wynn E. Wood
*Attorney, Agent, or Firm*—Zarley, McKee, Thomte, Voorhees, & Sease

[57] ABSTRACT

A joist support beam is comprised of an elongated substantially flat horizontal flange with a plurality of spaced upstanding brackets or web segments secured to the flange. Joist gripping elements are secured to the upper ends of the brackets and are comprised of hollow sleeves having threaded bolts therein which protrude in opposite directions therefrom. Plates are secured to the outer ends of the bolts for tight engagement with transverse joists extending across the plate in-between the upstanding brackets. A method of providing more headroom under joists using the aforementioned beam structure comprises positioning the beam structure so that the joists extend transversely across through the spaces between the upstanding web segments or brackets, extending the bolts from the sleeves for tight engagement with the joist extending across the beam. Alternatively, apertures are cut in the joists with a rigid member or sleeve placed within the aperture for the joist gripping means to tightly bear against.

12 Claims, 1 Drawing Sheet

METHOD AND MEANS FOR SUPPORTING OVERHEAD JOISTS TO CREATE GREATER HEADROOM

BACKGROUND OF THE INVENTION

It is conventional to support a plurality of parallel spaced joists by extending thereunder at one or more locations along their lengths a support beam extending usually at right angles to the joists. This arrangement means that the effective headroom of the resulting structure is the vertical space below the bottom portion of the beam rather than the bottom portion of the joists. This is because the full height of the beam extends below the bottom portion of the joists. The protruding beam normally adversely affects the esthetics of the resulting structure.

It is therefore a principal object of this invention to provide a method and means for supporting overhead joists to create greater headroom.

A further object of this invention is to provide a method and means for supporting overhead joists wherein the joists are supported on the lower flange of a supporting beam, with spaced web segments on the flange being secured to the upper portions of the joists to in effect create an upper structural flange for the beam.

A further object of this invention is to provide a method and means for supporting overhead joists which is easily and inexpensively installed.

These and other objects will be apparent to those skilled in the art.

SUMMARY OF THE INVENTION

This invention involves a joist support beam comprised of an elongated substantially flat horizontal flange with a plurality of spaced upstanding brackets or web segments secured to the flange. Joist gripping means are secured to the upper ends of the brackets and are comprised of sleeves having threaded bolts therein which protrude in opposite directions therefrom. Plates are secured to the outer ends of the bolts for tight engagement with transverse joists extending across the plate in-between the upstanding brackets.

The method of this invention involves providing the aforementioned beam structure, positioning the beam structure so that the joists extend transversely across through the spaces between the upstanding web segments or brackets, extending the bolts from the sleeves for tight engagement with the joist extending across the beam. Alternatively, apertures can be cut in the joists with a rigid member or sleeve placed within the aperture for the joist gripping means to tightly bear against.

DESCRIPTION OF THE PREFERRED EMBODIMENT

Figures 1, 2, 3, 4, 5:
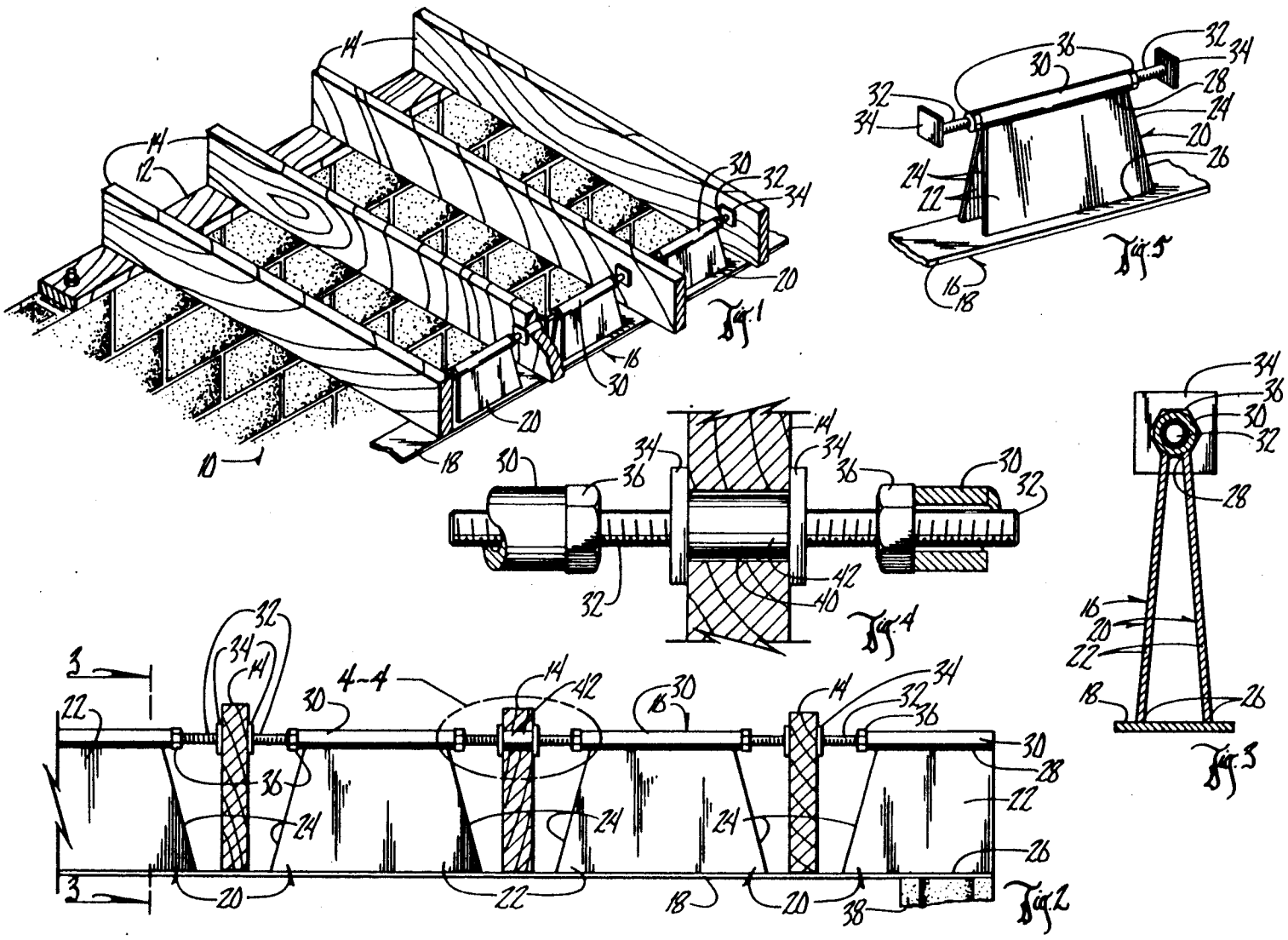
FIG. 1 is a partial perspective view of a floor section utilizing the beam of this invention.
FIG. 2 is a partial enlarged scale elevational view of the beam structure shown in FIG. 1.
FIG. 3 is an enlarged scale sectional view taken on line 3—3 of FIG. 2.
FIG. 4 is an enlarged scale sectional view taken on line 4—4 of FIG. 2.
FIG. 5 is a perspective view of the web segment of the supporting beam.

In FIG. 1, a concrete block wall 10 or the like having a plate 12 thereon supports one end of joist 16.

The beam 16 of this invention is comprised of a lower plate or flange 18 having a plurality of spaced brackets or web segments 20 extending upwardly therefrom. The brackets are comprised of opposite plates 22 having tapered sides 24, lower edges 26 and upper edges 28. The brackets 20 are welded to the plate 18 along the lower edge 26 of the plates 22. The plates 22 are inclined towards each other and the upper edges 28 are welded to a horizontally disposed hollow sleeve 30 which extends in the same direction as the longitudinal axis of plate 18.

Threaded bolts 32 are inserted into the hollow sleeves 30 and extend in opposite directions from the ends of the sleeves. Plates 34 are welded to the outer ends of bolts 32. A lock nut 36 is threadably mounted on each of the bolts 32.

As shown in FIG. 2, a support post or wall 38 is placed underneath the ends of the beam to support it in the position shown in FIG. 1.

Apertures 40 (FIG. 4) can be cut in the joist 14 to receive a solid sleeve or block 42 having the same width and size as the aperture 40. As will be described hereafter, the presence of block 42 prevents pressure from plates 34 from crushing the joist as pressure is exerted on the joist.

The normal operation of this invention, and the method of use of this invention is as follows: The joists 14 are extended across the plate 18 in between the brackets 20. The bolts 32 are in a partially recessed position within the sleeves 30 so as to provide clearance for the joists 14 and to permit the joists 14 to completely extend across the plates 18.

The bolts 32 can then be rotatably screwed outwardly out of the sleeves (by rotating the bolts with respect to nuts 36, or vice versa) until opposite plates 34 engage the side edges of the joist dwelling between the plates. Substantial pressure of the bolts 32 and plates 30 against the joists can be created by exerting additional rotational force on the lock nuts 36 which bear against the ends of sleeves 30.

Alternatively, to prevent the width of the joist from being crushed by the pressure of the bolts 32 and the plates 34, the aperture 40 can be cut in the joist before the plates 34 engage the joist. The blocks 42 can be placed in the aperture so that the blocks endure the compressive forces of the plates 34.

While the brackets 20 are shown to be comprised of two plates 22, the invention would work reasonably well if only a single plate were used.

This invention places the plate 18 at the lower level of the joist 14 which substantially increases the headroom underneath the joints as compared to a typical I-beam or the like which has its full height extending below the lower portion of the joist which it supports. The structural integrity of the beam is assured since the effect of an upper compressive web is created by the bolts 32, plates 34 and joists 14 with or without sleeves 42.

It is therefore seen that this invention will achieve all of its stated objectives.

I claim:

1. A joist support beam, comprising an elongated substantially flat horizontal flange adapted to have a plurality of spaced joists extending transversely thereacross and resting thereon, a plurality of spaced joists extending transversely thereacross and resting thereon, a plurality of spaced upstanding brackets having upper ends, and lower ends secured to said flange, joist gripping means secured to the upper ends of said brackets comprising joist gripping members movable outwardly from said brackets so that joists resting on said horizontal flange between said brackets can be frictionally engaged by oppositely disposed joist gripping members on adjacent brackets.

2. The device of claim 1 wherein said joist gripping means further comprise horizontal hollow sleeves having opposite ends secured to the upper ends of said brackets, said sleeves being parallel to the length of said flange, with said joist gripping members being movably mounted within the opposite ends of said sleeve.

3. The device of claim 2 wherein said joist gripping members are threaded bolts having inner ends inserted in the one end of one of said sleeves, and an outer end, a plate on said outer ends of said bolts for engaging said joists, and threadable means on said sleeves for forcibly holding said plates in tight engagement with said joists.

4. The device of claim 1 wherein said joist gripping members frictionally engage rigid block means extending through said joists.

5. The device of claim 1 wherein said brackets are plates having side edges that are tapered upwardly and inwardly towards each other.

6. The device of claim 2 wherein said brackets are a pair of plates having upper and lower edges, with said lower edges being spaced and welded to said flange, with said upper ends being welded to said sleeve, said pair of plates being inclined towards each other so that said upper edges are more closely spaced than said lower edges.

7. A beam support structure, comprising a plurality of spaced parallel joists, a support beam under said joists, said support beam comprising an elongated substantially flat horizontal flange vertically supporting said joists, a plurality of spaced upstanding brackets having upper ends, and lower ends secured to said flange, at least one of said joists resting on said flange in-between said brackets, joist gripping means secured to the upper ends of said brackets comprising joist gripping members movable outwardly from said brackets so that joists resting on said horizontal flange between said brackets can be frictionally engaged by oppositely disposed joint gripping members on adjacent brackets.

8. The device of claim 7 wherein said joist gripping means further comprise horizontal hollow sleeves having opposite ends secured to the upper ends of said brackets, said sleeves being parallel to the length of said flange, with said joist gripping members being inserted within the opposite ends of said sleeve.

9. The device of claim 8 wherein said joist gripping members are threaded bolts having inner ends inserted in the one end of one of said sleeves, and an outer end, a plate on said outer ends of said bolts for engaging said joists, and threadable means on said sleeves for forcably holding said plates in tight engagement with said joists.

10. The device of claim 7 wherein said joist gripping members frictionally engage rigid block means extending through said joists.

11. The device of claim 7 wherein said brackets are plates having side edges that are tapered upwardly and inwardly towards each other.

12. The device of claim 8 wherein said brackets are a pair of plates having upper and lower edges, with said lower edges being spaced and welded to said flange, with said upper ends being welded to said sleeve, said pair of plates being inclined towards each other so that said upper edges are more closely spaced than said lower edges.

* * * * *